United States Patent [19]

Kusuda

[11] Patent Number: 5,041,876

[45] Date of Patent: Aug. 20, 1991

[54] MULTI-COLOR IMAGE FORMING APPARATUS INCORPORATING SELECTIVELY OPERABLE DEVELOPING UNITS FOR ONE CYCLE COPYING

[75] Inventor: Yasuhiro Kusuda, Osaka, Japan

[73] Assignee: Minolta Camera Kabushiki Kaisha, Osaka, Japan

[21] Appl. No.: 465,620

[22] Filed: Jan. 19, 1990

Related U.S. Application Data

[63] Continuation of Ser. No. 221,545, Jul. 20, 1988, abandoned.

[30] Foreign Application Priority Data

Jul. 21, 1987 [JP] Japan ..... 62-181776

[51] Int. Cl.[5] ..... G03G 15/09

[52] U.S. Cl. ..... 355/251; 355/326

[58] Field of Search ..... 355/251, 245, 246, 326, 355/327, 328

[56] References Cited

U.S. PATENT DOCUMENTS

| | | | |
|---|---|---|---|
| 2,910,963 | 11/1959 | Herman . | |
| 3,572,288 | 6/1968 | Turner . | |
| 3,914,043 | 10/1975 | McVeigh . | |
| 3,960,445 | 6/1976 | Drawe . | |
| 3,967,891 | 7/1976 | Rippstein . | |
| 4,099,860 | 7/1978 | Connin . | |
| 4,346,982 | 8/1982 | Nakajima et al. . | |
| 4,373,798 | 2/1983 | Tsukada et al. . | |
| 4,572,102 | 2/1986 | Yuge et al. . | |
| 4,579,443 | 4/1986 | Abuyama et al. . | |
| 4,591,261 | 5/1986 | Saruwatari et al. | 355/251 |
| 4,619,514 | 10/1986 | Ide . | |
| 4,627,707 | 12/1986 | Tani et al. . | |
| 4,634,259 | 1/1987 | Oishi et al. . | |
| 4,641,602 | 2/1987 | Kasai . | |
| 4,657,376 | 4/1987 | Ide . | |
| 4,659,211 | 4/1987 | Oka . | |
| 4,666,288 | 5/1987 | Watanabe . | |
| 4,685,794 | 8/1987 | Watanabe . | |
| 4,690,543 | 9/1987 | Watanabe . | |
| 4,710,016 | 12/1987 | Waatanabe . | |
| 4,720,730 | 1/1988 | Ito . | |
| 4,723,148 | 2/1988 | Hamakawa . | |
| 4,728,985 | 3/1988 | Nakashima et al. . | |
| 4,740,811 | 4/1988 | Watanabe . | |
| 4,743,945 | 5/1988 | Ito et al. . | |
| 4,743,946 | 5/1988 | Nishimori et al. . | |
| 4,745,437 | 5/1988 | Oka et al. . | |
| 4,746,954 | 5/1988 | Matuura et al. . | |
| 4,754,301 | 6/1988 | Kasamura et al. . | |
| 4,772,921 | 9/1988 | Ito . | |
| 4,774,543 | 9/1988 | Yoshikawa et al. | 355/251 |
| 4,792,225 | 12/1988 | Itaya | 355/251 |

FOREIGN PATENT DOCUMENTS

| | | |
|---|---|---|
| 3705511 | 9/1987 | Fed. Rep. of Germany . |
| 48-22212 | 7/1973 | Japan . |
| 51-134635 | 11/1976 | Japan . |
| 54-30833 | 3/1979 | Japan . |
| 60-170868 | 9/1985 | Japan . |
| 60-212778 | 10/1985 | Japan . |
| 61-72270 | 4/1986 | Japan . |
| 61-203474 | 9/1986 | Japan . |
| 61-208063 | 9/1986 | Japan . |

*Primary Examiner*—R. L. Moses

*Attorney, Agent, or Firm*—Burns, Doane, Swecker & Mathis

[57] ABSTRACT

In a multi-color copying apparatus including a plurality of developing units containing developers in different colors, respectively, the improvement comprising: said developing units each including a magnet roller, a rotatable sleeve roller and a changeover means for changing over each of said developing units between a developing state and a nondeveloping state; in at least one of said developing units disposed downstream of the remaining ones of said developing units in a direction of displacement of a photosensitive member, said changeover means including a first means for effecting angular displacement of said magnet roller between developing and nondeveloping positions at which one of magnetic poles of said magnet roller confronts and does not confront said photosensitive member, respectively, and a second means for turning on said sleeve roller for its rotational drive such that at the time of changeover of said one of said developing units from the nondeveloping state to the developing state, said second means is actuated upon lapse of a predetermined time period after actuation of said first means.

3 Claims, 6 Drawing Sheets

POWER SOURCE
SIMUL. COL. SW (62)
PRINT SW (61)
REED SWITCH (110)
2nd DEV. SOL. (33')
1st DEV. SOL. (33)
2nd DEV. M. (24')
1st DEV. M (24)
2nd DEV. BIAS (Vb')
1st DEV. BIAS (Vb)
SCAN START
SCAN COMPL.
ON
OFF
0(V)
Vb1
Vb2
Vb1'
Vb2'
t1
t2
t3

MULTI-COLOR IMAGE FORMING APPARATUS INCORPORATING SELECTIVELY OPERABLE DEVELOPING UNITS FOR ONE CYCLE COPYING

This application is a continuation of application Ser. No. 221,545, filed July 20, 1988 now abandoned.

FIELD OF THE INVENTION

The present invention relates to an image forming apparatus such as a copying machine and the like, and more particularly, to a multi-color image forming apparatus having a function for reproducing an image of an original document in a plurality of colors.

BACKGROUND OF THE INVENTION

Recently, as one type of an image forming apparatus, there has been proposed a multi-color image forming apparatus which is so arranged that, with a plurality of developing units respectively containing developers in different colors being disposed around a photosensitive drum, a series of image forming processings such as corona charging, exposure, partial erasing, developing, transfer and fixing, etc. is effected two times, thereby reproducing an image of one sheet of an original document in a plurality of colors.

In the known image forming apparatus as described above, however, particular paper passage means is required for guiding a copy paper sheet formed with the image at a first image forming process into a second image forming process, thus resulting in a large size of the apparatus and complication in its construction.

Moreover, in the above conventional arrangement, since the copy paper sheet continuously passes through the two image forming processes, and is subjected to mechanical and thermal stress during that time, it tends to be damaged through formation of wrinkles and curls, thereby giving rise to paper jamming or deviation in the position of copied images.

In order to solve these problems, the assignee of the present invention has proposed in U.S. patent application Ser. No. 148,423 filed on Jan. 25, 1988 a multi-color image forming apparatus having a copying mode (hereinbelow, refered to as a "simultaneous color copying mode") in which by selectively driving a plurality of developing units containing developers in different colors, respectively, during one cycle of copying operation, for example, a region from a forward edge of an original document to a first point is reproduced with a first color, a region from the first point to a second point is reproduced with a second color, and a region from the second point to a rear edge of the original document is reproduced with the first color again.

Meanwhile, in the developing units of the multi-color image forming apparatus having the simultaneous color copy mode, a magnet roller in which a plurality of magnets having axillary extending magnetic poles are arranged in a circumferential direction is disposed in a developing sleeve. The developing sleeve is rotationally driven at the time of development, but is stopped to rotate at the time of nondevelopment. Besides, positions of the magnetic poles of the magnet roller are changed over at the time of development and nondevelopment. Namely, at the time of development, a magnetic brush is brought into contact with a surface of an electrostatic latent image support member, while at the time of nondevelopment, the magnetic brush is substantially held out of contact with said surface such that supply of the developers to said surface from the developing units not in use is cut off, thereby preventing mixing of colors and thin colors in the image.

While, if changeover of the developing sleeve is performed concurrently with changeover of magnet roller upon the changeover from nondeveloping state to the developing state, a great centrifugal force due to not only a transport force based on rotation of the developing sleeve but a transport force based on displacement of the magnetic poles of the magnet roller is exerted on the developers temporarily.

Thus, the copying apparatus as mentioned above has such a drawback that some of the developers on the developing sleeve may scatter to the surface of the electrostatic latent image support member and scattering patterns made by the developers are formed in the vicinity of the boundary portions of the image so as to deteriorate the image quality.

SUMMARY OF THE INVENTION

The present invention has for its object to provide a multi-color image forming apparatus in which a high-quality image free from scatter of developers in the vicinity of boundary portions of the image can be obtained.

In a multi-color copying apparatus including a plurality of developing units containing developers in different colors, respectively, in which an electrostatic latent image formed on a surface of a photosensitive member is developed into a multi-color image by selectively driving said developing units during one cycle of copying operation, the improvement comprising: said developing units each including a magnet roller having a plurality of magnetic poles, a rotatable sleeve roller surrounding said magnet roller and a changeover means for changing over each of said developing units between a developing state and a nondeveloping state; in at least one of said developing units disposed downstream of the remaining ones of said developing units in a rotational direction of said photosensitive member, said changeover means including a first means for effecting angular displacement of said magnet roller between developing and nondeveloping positions at which one of the magnetic poles of said magnet roller confronts and does not confront said photosensitive member, respectively, and a second means for turning on said sleeve roller for its rotational drive such that at the time of changeover of said one of said developing units from the nondeveloping state to the developing state, said second means is actuated upon lapse of a predetermined time period after actuation of said first means.

BRIEF DESCRIPTION OF THE DRAWINGS

Features of the present invention will become apparent from the following description taken in conjunction with the preferred embodiment thereof with reference to the accompanying drawings, in which.

DETAILED DESCRIPTION OF THE INVENTION

Figure 1:
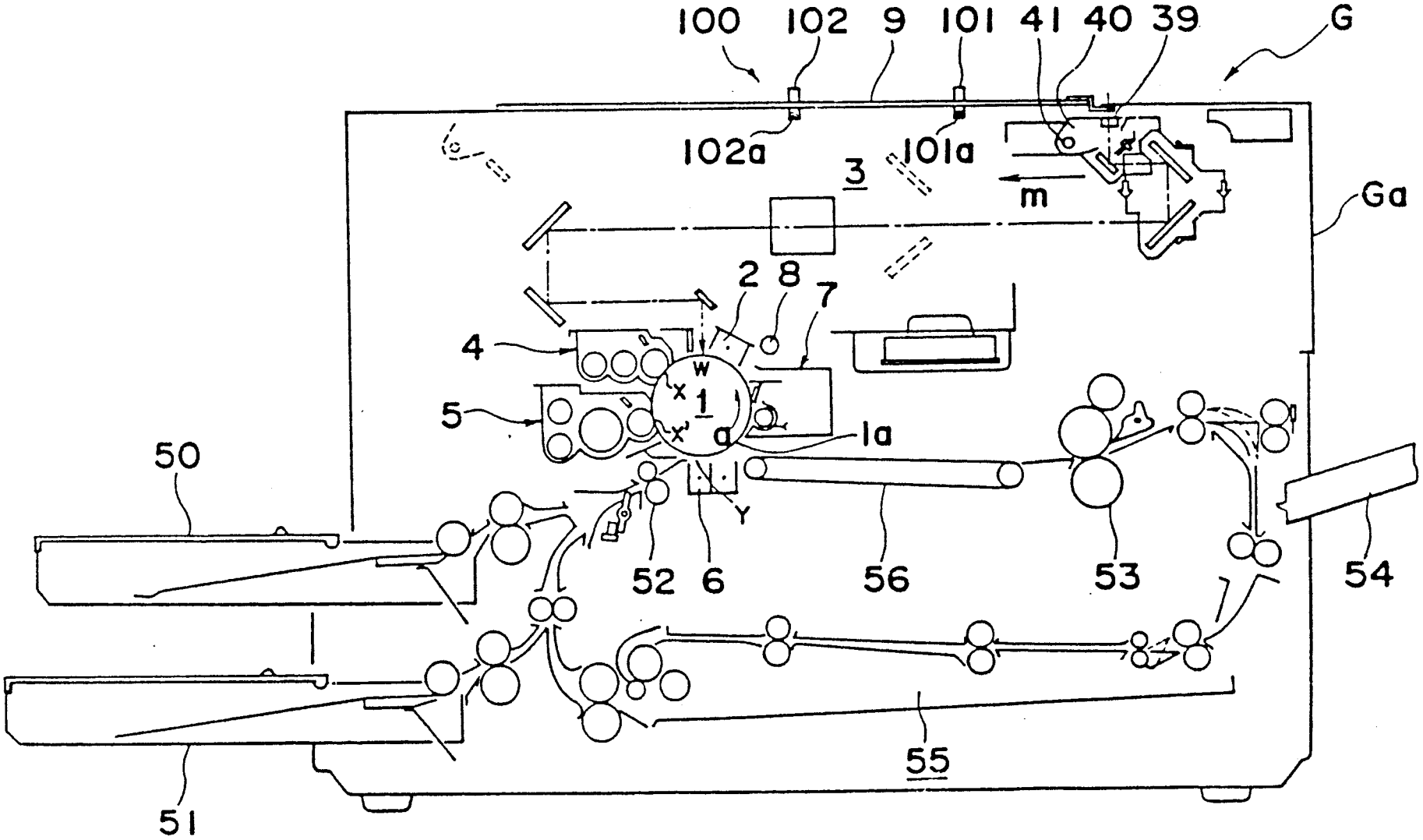
FIG. 1 is a schematic sectional view of a multi-color image forming apparatus according to one preferred embodiment of the present invention.

Before the description of the present invention proceeds, it is to be noted that like reference numerals have been used throughout to designate like elements in the drawings.

Referring now to the drawings, there is shown in FIG. 1, a single-scan, bi-color electrographic copying machine to which the present invention may be applied, the general construction of which will be described hereinbelow together with the standard copying operation for reproducing an image of an original document as it is.

As depicted in FIG. 1, this copying machine employs a photosensitive drum 1 having a photosensitive surface 1*a* on its exterior circumference and mounted rotatably at a central portion of a machine housing for rotation in the direction indicated by an arrow a. As is well known to those skilled in the art, during one complete rotation of the photosensitive drum 1, the photosensitive drum 1 moves sequentially past a series of processing stations.

The photosensitive drum 1 initially rotates photosensitive surface 1*a* through charging station. At charging station, a corona generating device 2 generates a spray of ions which are deposited on photosensitive surface 1*a* producing a relatively high, a predetermined amount of uniform electrical charge thereon.

After the photosensitive surface is charged, the photosensitive drum 1 is rotated to exposure station W. At exposure station W, a ribbon of light carrying an image of that original document placed on a document support 9 which is succesibly scanned by a movable illuminator assembly of scanner 40 is projected onto the photosensitive surface 1*a* via reflecting mirrors and lens assembly, and thus, a electrostatic latent image corresponding to the original document is formed on said surface 1*a*.

After the electrostatic latent image is formed on photosensitive surface 1*a*, the photosensitive drum 1 rotates to development station.

At development station, a developer material is applied to develop the electrostatic latent image into a visible toner image which is the reproduction of original document at a developing region X or X' corresponding in position to the first developing unit 4 or second developing unit 5.

After the electrostatic latent image is developed into the toner image, the photosensitive drum 1 rotates to transfer station at which the transfer charger 6 is disposed.

Meanwhile, the copying sheet is supplied selectively from one of supply unit 50 or 51 by way of a timing roller pair 52 synchronized with the toner image formed on the photosensitive surface 1*a* to the transfer station, and therefore the toner powder image is transferred thereon from the photosensitive surface 1*a*.

After the toner powder image has been transferred onto the copying sheet, the photosensitive drum 1 rotates to a cleaning station at which a cleaning unit 7 and an eraser lamp 8 are disposed one after another with respect to the direction of a rotation of the drum 1 for removing residual toner and residual electrostatic charge remaining on the photosensitive surface of the drum 1, respectively, in readiness for the next cycle of electrostatic copying process.

Thereafter, the copying sheet with toner powder image is conveyed by a endless belt conveyor 56 towards a fixing roller pair 53 so that the toner powder image is fixed thereon by heat fusion of toner, and is then transported towards a copy receiving tray 54.

However, if a duplex or opposite side copying mode has been selected, the copy paper sheet is transported into a duplex device 55 so as to be turned over in its front and reverse faces thereat, and then, again transported to the transfer region Y, while at the optical system 3 and around the photosensitive drum 1, a second copying operation is performed in the similar manner as before so as to form the image on the reverse face of the copy paper sheet this time.

In addition to the copying mode as described so far, the copying machine is capable of effecting a simultaneous color copying function to obtain a copy which has two portions thereof in different colors by moving the scanner 40 to one scanning function. For this purpose, the copying machine comprises an image editing mechanism 100 and special mechanisms are, respectively, provided for the developing units 4,5.

The details of the each of the first and second developing units 4 and 5 will now be described.

Figure 2:
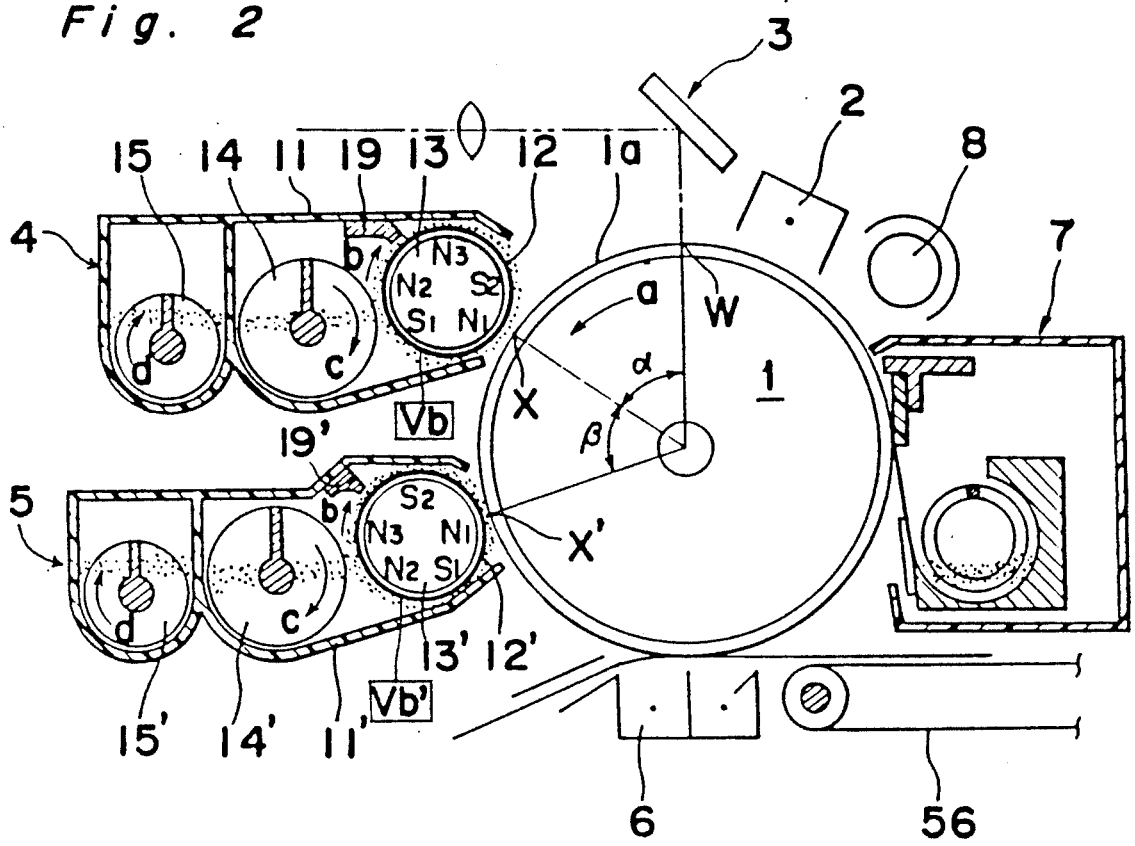
FIG. 2 is a fragmentary sectional view showing, on an enlarged scale, a photosensitive drum and devices provided therearound in the apparatus of FIG. 1.
Figure 3:
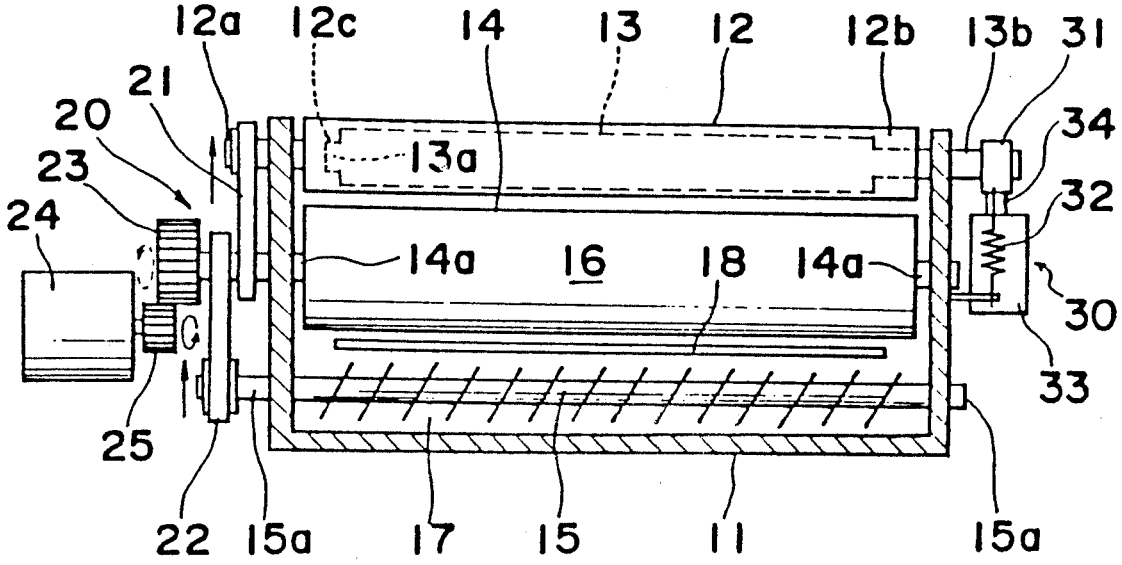
FIG. 3 is a longitudinal sectional view showing, on a still enlarged scale, a developing unit employed in the apparatus of FIG. 1.
Figure 4:
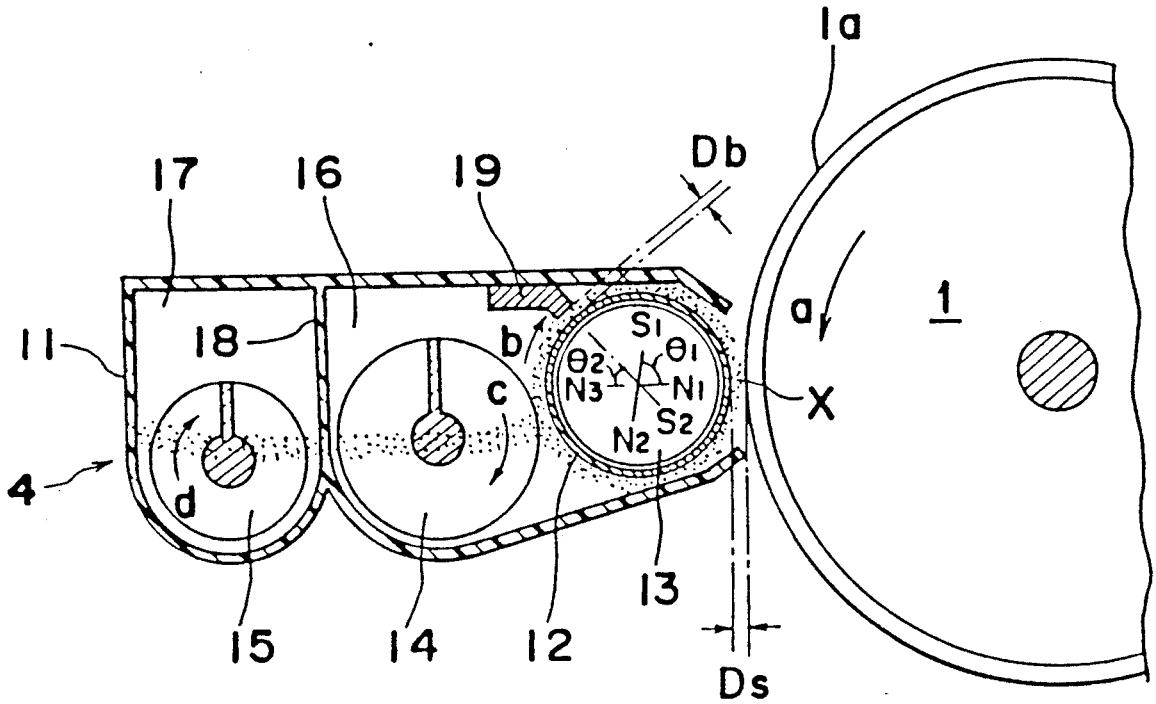
FIGS. 4 and 6 are transverse sectional views of the developing unit showing relation thereof with respect to the photosensitive drum.

Referring now to FIGS. 2 to 4, each of the developing units 4 and 5 which are of the same construction, comprises a casting or tank 11, the interior of which is divided by a partition wall 18 into receiving and dispensing chamber 17, 16 which are communicated with each other at opposite sides of the tank 11.

The developing units also comprises a supply roller 14 disposed rotatably within the receiving chamber 16, a screw feeder 15 disposed rotatably within the receiving chamber 17, and a developing sleeve 12 positioned one side of supply roller 14 remote from the screw feeder 15 and disposed rotatably within the dispensing chamber 16 with a portion of the exterior circumference thereof exposed outwardly through an associated wall portion of the tank 11 to confront the first or second developing region X or X' on the photosensitive drum 1.

The developing sleeve 12 is in the form of hollow cylinder made of non-magnetizeable, electorconductive material having a predetermined diameter, for example, 24.5 mm, and has its exterior circumferential surface roughened finely by the use of a sand blasting technique.

That portion of the exterior circumferential surface of the developing sleeve 15, which is exposed outwardly of the tank 11 so as to confront the first or second developing site X or X' forms a developing gap Ds of, (0.6 mm), between it and a portion of the photosensitive surface 1*a* of the photosensitive drum 1 confronting the first or second developing site X or X'. It is to be noted that the angle of rotation of the drum 1 from the exposure point W to the associated first or second developing site X or X' is chosen to be $\alpha$ or $(\alpha+\beta)$. By way for example, the angle $\alpha$ may be 56° and the angle $\beta$ may be 52°.

A variable developing bias voltage Vb is applied to the developing sleeve 12.

Meanwhile, at the back face of the developing sleeve 12 with respect to the developing region X, a bristle height adjusting member 19 is so supported at the inner portion of the developing tank 11 that one side edge of bristle height adjusting member 19 can be spaced a distance Db (0.4 mm).

Within the hollow of the developing sleeve 12, there is disposed a magnet roller 13 having a plurality of magnets extending in the axial direction, and magnet forces of magnetic poles N1,N2, and N3, and S1 and S2 located at outer peripheral faces of such magnets are respectively set as N1=1000 G, N2 and N3=500 G, and S1 and S2=800 G (G is an abbreviation of a unit gauss).

As shown in FIG. 4, the center of magnetic pole N1 is located at a position displaced clockwise from the center of the magnetic pole S1 by $\theta 1$ (80°), while the center of the magnetic pole N3 is adapted to be located at a position displaced counterclockwise from the portion confronting the bristle height adjusting member 19 by $\theta 2$ (40°), under the state where the magnetic pole N1 faces the surface 1*a* of the photosensitive drum 1.

As is seen in FIG. 3, the magnet roller 13 has one end 13*a* of its shaft supported in a bearing recess 12*c* formed in the developing sleeve 12, and other end 13*b* thereof supported by a side wall of the developing tank 11, so as to rotate about between first and second position spaced a predetermined angle ($\theta 1$=40°) by a displacing means to be described in detail hereinbelow.

Meanwhile, the developing sleeve 12 has its bearing portion 12*b* at the right side in FIG. 3 supported by the shaft 13*b* of the magnet roller 13, with its shaft 12*a* at the left side being supported by the side wall of the developing tank 11, so as to be driven for rotation by a driving means 20.

The supply roller 14 and the screw feeder 15 are respectively disposed in the dispensing chamber 16 and receiving chamber 17 divided by the partition wall 18, and have its both ends of the shaft 14*a*, 15*a* supported by the side wall of the developing tank 11 so as to be driven for rotation by the driving means 20.

Subsequently, the driving means 20 for the developing units 4, 5, supply roller 14, and screw feeder 15 will be described.

Still referring to FIG. 3, a endless belt is passed around the shaft 12*a* of the developing sleeve 12 and the shaft 14*a* of the supply roller 14, and another endless belt 22 is directed around the shaft 14*a* of the supply roller 14 and the shaft 15*a* of the screw feeder 15.

Meanwhile, a gear 23 is mounted on the end of the shaft 14*a* of the supply roller 14, and the gear 23 is engaged with a drive gear 25 of the motor 24.

Accordingly, when the motor 24 is driven and the driving gear 25 is rotated in the direction indicated by a solid line arrow in FIG. 2, the gear 23 and the belts 21 and 22 are turned in the direction shown by a dotted line arrow, and thus, the developing sleeve 12, supply roller 14 and screw feeder 15 are respectively rotated in the directions shown by the arrows b, c, d in FIG. 2. It is to be noted here that the developing sleeve 12 is arranged to be rotated at 240 rpm in this embodiment.

Figure 5:
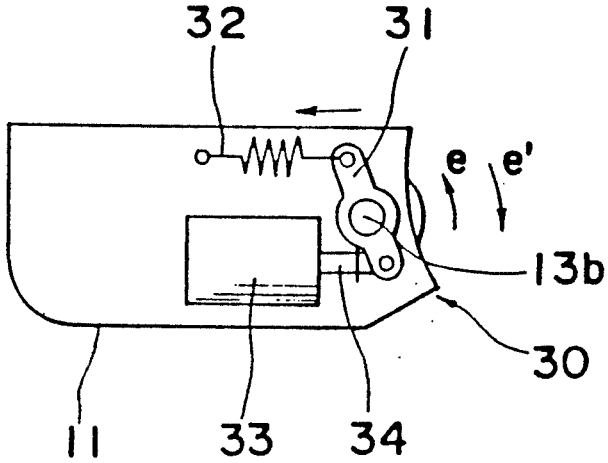
FIGS. 5 and 7 are side elevational views of a moving means employed for the developing unit.
Figure 7:
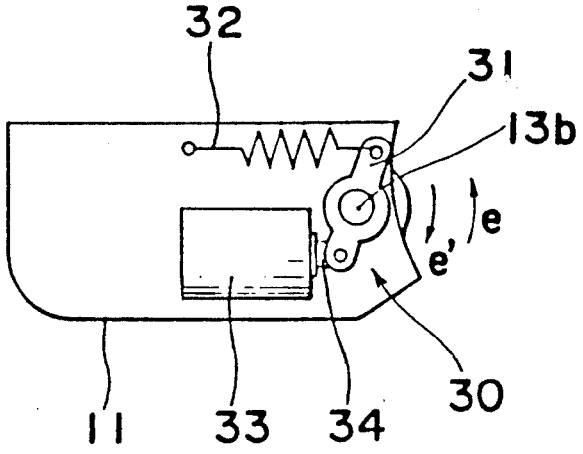

As shown in FIGS. 5 and 7, the displacing means 30 of the magnet roller 13 is constituted by a lever 31, a spring 32 and a solenoid 33. The lever 31 is fixed to the end of the shaft 13*b* for the magnet roller 13, to one end of the said lever 31, corresponding one end of the spring 32 fixed to the developing tank 11 is connected so as to normally urge the lever 31 in the direction indicated by an arrow e. Meanwhile, to the other end of the lever 31, the plunger 34 of the solenoid 33 is connected, so that upon driving of the solenoid 33, the lever 31 is rotated in the direction indicated by an arrow e' against the urging force of the spring 32.

When the solenoid 33 is not functioning, i.e., when the lever 31 is in the state as illustrated in FIG. 5, the magnetic pole N1 of the magnet roller 13 confronts the photosensitive drum 1, while the magnetic pole N3 confronts at a position displaced by the angle $\theta 2$ (40°) counterclockwise from the confronting position with respect to the bristle height adjusting member 19 as shown in FIG. 4.

On the contrary, when the solenoid 33 is driven and lever 31 is in the state as illustrated in FIG. 7, the magnetic pole N3 confronts the bristle height adjusting member 19, while a portion of the magnet roller 13 intermediate between the neighboring magnetic poles N1 and the magnetic pole S1 confronts the photosensitive drum 1.

Hereinafter, the detail of the image editing mechanism 100 will be described.

Figure 8:
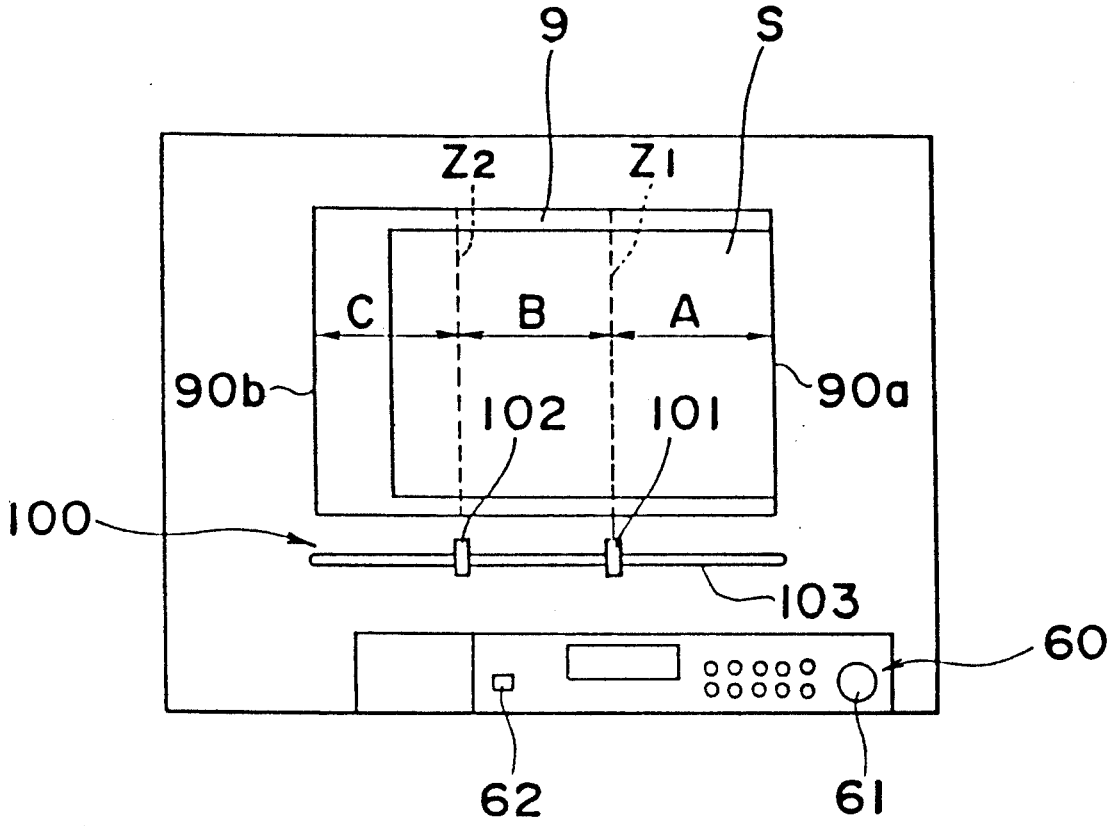
FIG. 8 is a top plan view of an image editing mechanism employed in the apparatus of FIG. 1.
Figure 9:
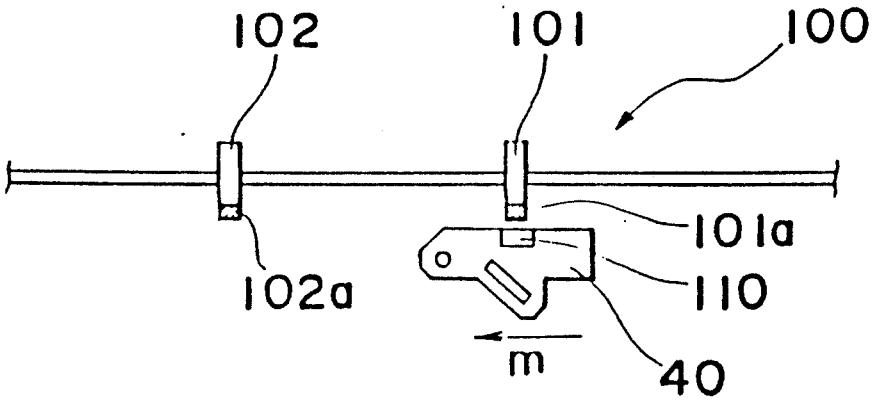
FIG. 9 is a sectional view of the image editing mechanism of FIG. 8.

In FIGS. 8 and 9, first and second levers 101 and 102 of the image editing mechanism 100 are arranged to designate the regions by dividing the surface of the transparent original document support 9 in the moving direction of the scanner 40 (in a direction indicated by an arrow m), with simultaneous designation of the reproducing color, and supported slidably in a guide slot 103 defined in a top panel of the machine housing so as to extend parallel to the scanning direction of the scanner 40. Each levers 101 and 102 have magnets 101*a* and 102*a* respectively under the top panel of the machine housing.

Thus, as illustrated in FIG. 8, in the state where the respective levers 101 and 102 are set, regions are designated in such a manner that the position from the forward edge 90*a* of the document support 9 to the first lever is a region A, the portion from the first lever 101 to the second lever 102 is a region B, and the portion from the second lever 102 to the rear edge 90*b* of the document support 9 is a region C, while the region A and C are designated as white and black, with the region B being designated as color.

The image editing mechanism 100 also include a reed switch 110 mounted on the scanner for movement together therewith said reed switch 110 being used to detect the magnets 101*a* and 102*a* to provide an output signal indicative of the positions of the magnets 101*a* and 102*a*, hence, the positions of the levers 101 and 102 to a control unit (not shown).

As shown in FIG. 8, the operating panel 60 includes a print switch 61 and a simultaneous color switch 62.

Figure 10:
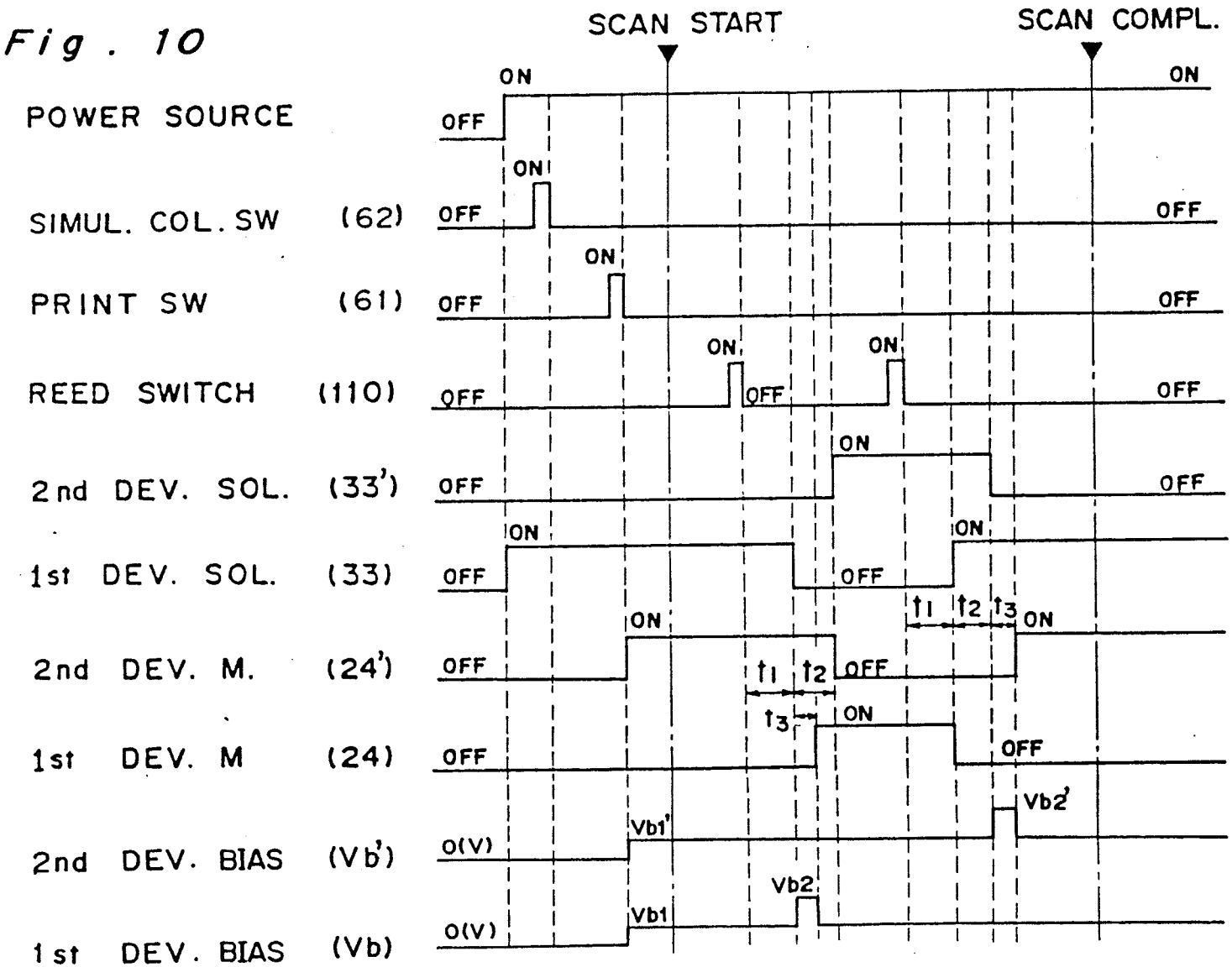
FIG. 10 is a timing chart showing control of the apparatus of FIG. 1.

The sequence of operation in the case of simultaneous color copying will be described with reference to a timing chart of FIG. 10. It should be noted here that the numerals for constituent elements of the second developing unit 5 are marked with "prime"(') for differentiation from those of the developing unit 4.

It is to be noted that the first developing unit 4 contains developers composed of magnetic carrier and insulating color toner, while the second developing unit 5 contains developers composed of magnetic carrier and insulating black toner in common use.

Figure 6:
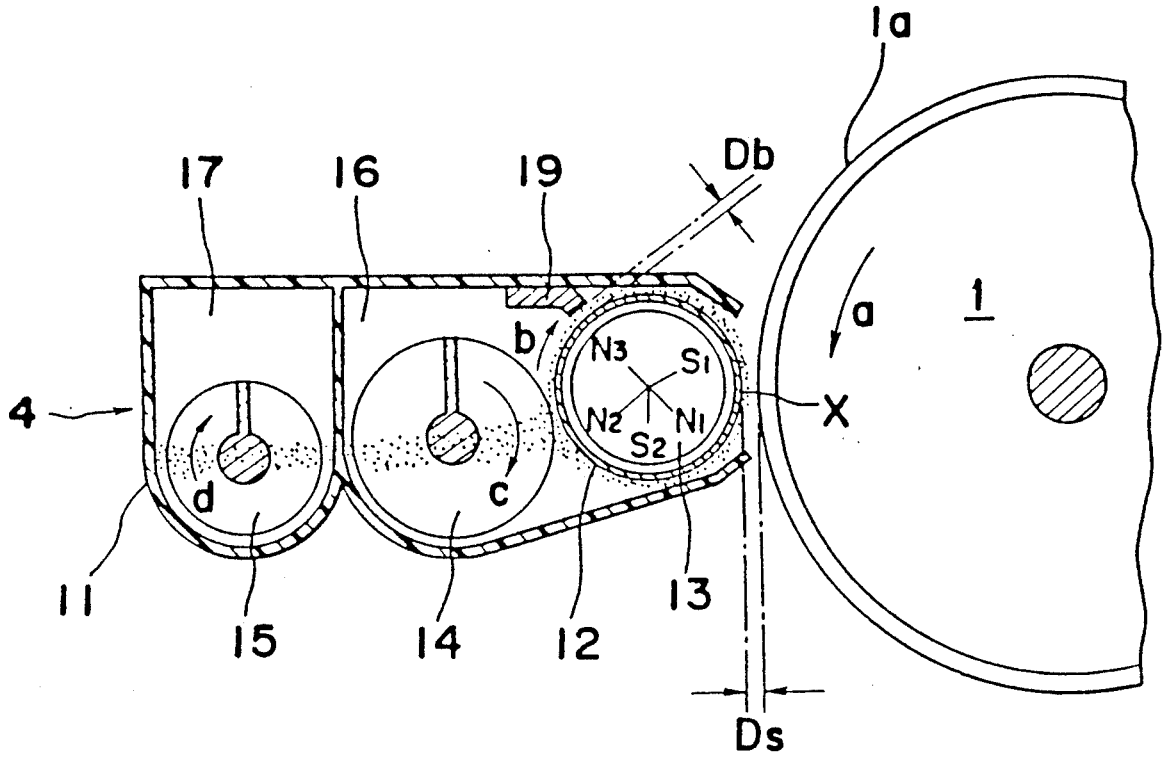

In the first place, when the copying machine is powered, the intermediate portion between the neighboring magnetic poles N1 and S1 of the magnet roller confronts the photosensitive surface 1*a* of the drum 1 in the first developing unit 4 as shown in FIG. 6 while the magnetic pole N1′ confronts said surface 1*a* in the second developing unit 5 as illustrated in FIG. 4.

Upon turning on of the print switch 61 in the above state, the second developing unit 5 is automatically driven for effecting the standard copying function, and when the simultaneous color switch 62 is turned on, the setting is so made that the simultaneous color copying can be effected. It is to be noted, however, that even if this simultaneous color switch 62 is depressed during the copying operation, the simultaneous color copying is not carried out.

When the simultaneous color switch 62 has been turned on, the copying mode is changed from an ordinary copying mode to a simultaneous color copying mode, and the developing bias voltages Vb and Vb′ of the first and second developing units 4 and 5 are set to Vb1 and Vb1′, respectively. The developing bias voltages Vb1 and Vb1′ are set to 150 V, respectively, when the photosensitive surface 1*a* of the photosensitive drum 1 is charged to 500 V.

Hereinafter, the black and white region A and C, and color region B are designated as shown in FIG. 8 by moving the first and second levers 101 and 102 along the guide slot 103.

It should be noted here that the levers 101 and 102 are effective only when the simultaneous color copying is selected, and arranged not to function at all, even if operated at a time other than above.

Under the state set as described so far, when the print switch 61 is turned on, with an original document S placed on the document support 9 as shown in FIG. 8, a developing motor 24′ for the second developing unit 5 is start, and the developing sleeve 12′, supply roller 14′ and screw feeder 15′ are respectively rotated in the directions indicated by the arrows b, c and d.

Accordingly, the developers containing the black toner and accommodated in the developing tank 11′ is circulated for transportation through the dispensing chamber 16′ and receiving chamber 17′, while being mixed and stirred based on the rotation of the supply roller 14′ and screw feeder 15′, and part of the developers is supplied onto the surface of the developing sleeve 12′ by the supply roller 14′ so as to form the magnetic brush of the developing on said developing sleeve 12′.

The magnetic brush thus formed passes through the brush bristle height adjusting gap Db as it is cut off by the bristle height adjusting member 19′ based on the rotation of the developing sleeve 12′, so as to be successively fed out into the developing region X′ for establishing the state capable of developing the electrostatic latent image formed on the photosensitive surface 1*a* of the photosensitive drum 1.

Meanwhile, based on the turning on of the print switch 61, the scanner 40 starts functioning in the direction of the arrow m so as to project light onto an original document S placed on the document support 9, and the light reflected therefrom is projected onto the photosensitive surface 1*a* of the drum 1 at the exposure point W so as to form the electrostatic latent image of the original document S on said surface 1*a*. The electrostatic latent image thus formed is first developed by the second developing unit 5.

Subsequently, when the reed switch 110 of the scanner 40 reaches at a boundary portion Z1 between the regions A and B, the magnet 101*a* of the first lever 101 is detected by the reed switch 110, and the reed switch 110 provides an output signal indicative of the position of the lever 101 to the control unit.

It is to be noted at this time point, the electrostatic latent image corresponding to a boundary portion Z, between the regions A and B where change-over is effected from black to color, is located at the exposure point W on the photosensitive surface 1*a* of the photosensitive drum 1, and during the time period (t1=0.22 sec) in which the boundary portion Z1 is displaced from the position of exposure point W up to the developing region X of the first developing unit 4, only the second developing unit 5 is successively operated.

After a time period t1 from the turning on of the reed switch 110 when the electrostatic latent image of the boundary portion Z1 reaches the developing region X, the solenoid 33 for the first developing unit 4 is turned off.

Thus, the solenoid 33 of the changeover means 30 for the first developing unit 4 is turned off, and the magnet roller 13 is rotated through a predetermined angle counterclockwise. Therefore, the first developing unit 4 is set in the state shown in the FIG. 4, while the first developing bias voltage Vb is changed from Vb1 (150 V) to Vb2 (300 V).

After a time period t3(=0.1 sec) from the turning off of the solenoid 33, the motor 24 of the driving means 20 is turned on, and the developing sleeve 12, supply roller 14, and screw feeder 15 rotates in the respective directions indicated by the arrows b, c, and d. Thus, the magnetic brush is formed on the surface of the developing sleeve 12, the first developing unit 4 is set in the state capable of developing the electrostatic latent image on the photosensitive surface 1*a* of the photosensitive drum 1, and function to supply the color toner to the latent image corresponding to the region B is started.

A reason for delaying starting of the motor 24 by a time period t3 from turning off of the solenoid 33 is as follows.

Namely, if the magnet roller 13 is rotated in the counterclockwise direction upon turning off of the solenoid 33, the developer on the developing sleeve 12 is subjected to a transport force exerted in the clockwise direction, i.e. in the direction of the arrow b through displacement of the magnetic poles. In addition, the developer is also subjected to the transport force exerted in the direction of the arrow b by rotation of the developing sleeve 12.

Accordingly, if turning on of the developing sleeve 12 coincides, in timing, turning off of the solenoid 33, the developer is temporarily subjected to an excessively large transport force and a centrifugal force due to the transport force so as to scatter towards the photosensitive surface 1*a* of the drum 1.

Therefore, the magnetic poles are initially displaced by rotating the magnet roller 13 and then, the developing sleeve 12 is rotated such that the centrifugal force applied to the developer is reduced and, in addition, an attractive force of the developing sleeve 12 exerted on the developer is increased by temporarily raising the developing bias voltage Vb, whereby scatter of the developer is prevented.

Therefore, the predetermined time period t3 is set at a time interval during which the magnetic brush is completely brought to a stop after completion of displacement of the magnetic poles, and the maximum of said period is such a period as not to kinder changeover of the colors.

Then, after a time period t2 from the turning off of the solenoid 33, i.e., after the time (t=0.2 sec) required for boundary portion Z1 of the electrostatic latent image to move from the first developing region X to the second developing region X' for the second developing unit 5, the motor 24' of the second developing unit 5 is turned off, while the solenoid 33' of the second developing unit 5 is turned on. By the above functions, the second developing unit 5 is set in the state as shown in FIGS. 6 and 7, the intermediate portion between the neighboring magnetic poles N1' and S1' confronts the photosensitive surface 1*a* of the photosensitive drum 1, with developing sleeve 12', supply roller 14' and screw feeder 15' stopping rotation, and thus, the developing function for the region A with black toner is terminated.

When scanner is further displaced, and reaches the position of the second lever 102, i.e., the boundary position Z2 between the neighboring regions B and C, the reed switch detects the magnet 102 so as to be again turned on for outputting the signal to the control unit. It is to be noted here, at this time, the electrostatic latent image corresponding to the boundary portion Z2 is located at the exposure point W.

After the time period t1 from the turning on of the reed switch 110, i.e., when the electrostatic static latent image at the boundary portion Z2 reaches the developing region X, the motor 24 for the first developing unit 4 is turned off, at the same time the solenoid 33 for the first developing unit 4 is turned, and thus, the developing function for the region B with color toner is terminated.

Furthermore, after the time period t2, i.e., when the electrostatic latent image corresponding to the boundary portion Z2 located at the developing region X reaches the developing region X' of the developing unit 5, the solenoid 33' for the second developing unit 5 is turned off. Subsequently, after the time period t3, the motor 24' for the second developing units 5 is driven.

As mentioned before, in the same manner as start of development of the region B, it is so arranged that starting of the motor 24' for the developing the region C is delayed by the time period t3 from turning off of the solenoid 33' and during the time period t3, the developing bias voltage Vb' is changed to Vb2' of 300 V. Thus, no developer is scattered towards the photosensitive surface 1*a* of the photosensitive drum 1 from the developing sleeve 12.

Hereinafter, the developing function of the second developing unit 5 is maintained until the termination of scanning, and after that the developing function for the region C with black toner is terminated.

By the above function, during the period from the starting of the scanning up to the completion thereof, a bi-color resultant copy, in which the developing color is changed over from black to color, further, to black, is obtained.

It is to be noted here that, in the above embodiment, the solenoids 33 and 33' are turned off earlier by the predetermined time period t3 than turning on of the motors 24 and 24' during development of boundary portions from the region A to the region B, and from the region B to the region C, and during the time period t3, the developing bias voltages Vb and Vb' are set to the high level to increase the attractive force of the developing sleeves exerted on the developers. However, the developing bias voltages Vb and Vb' are not necessarily required to be changed over to the high level.

Meanwhile, in this embodiment, it is so arranged that the magnet roller is displaceable between the developing position and the nondeveloping position in both the first and second developing units, and thus, the first and second developing units can be changed over between the developing state and the nondeveloping state by the displacement of the magnetic poles and the on/off operation of the developing sleeve. However, in the first developing unit disposed at the upstream side in the rotational direction of the photosensitive drum, the magnet roller is not necessarily required to be displaced.

For example, if the developing bias voltage is set to the nondeveloping level of the nondeveloping period, the electrostatic latent image may not be developed substantially even if the magnetic brush is in contact with the photosensitive surface. On the other hand, when the second developing unit located at the downstream side in the rotational direction of the photosensitive drum is in the nondeveloping state and the magnetic brush is in contact with the photosensitive surface, there is a possibility that the toner powder image on the photosensitive surface made by the first developing unit located at the upstream side is disturbed. Accordingly, the arrangement in which the magnet roller is displaced is required to be provided in at least the second developing unit located at the downstream side.

Moreover, in the foregoing embodiment, the arrangement for subjecting the exposure lamp of the optical system 3 to scanning function with the original document platform 9 fixed in the foregoing embodiment, may be modified so that the original document platform 9 is caused to scan, with the exposure lamp 41 held stationary.

As will be apparent from the description given so far, in the multi-color image forming apparatus of the present invention, when the developing unit is changed over from the nondeveloping state to the developing state during simultaneous color copying, the magnet roller is initially changed over to the state enabling development, and then, upon lapse of the predetermined period, drive of the developing sleeve is started.

Accordingly, the transport forces caused by changeover of the magnet rollers and by starting of rotation of the developing sleeve do not act on the developers on the developing sleeves at the same time, the developers are stably held on the developing sleeves without scattering therefrom to the photosensitive surface.

Consequently, an image free of scatter of the developers can be obtained.

Although the present invention has been fully described by way of example with reference to the accompanying drawings, it is to be noted here that various changes and modification will be apparent to those skilled in the art. Therefore, unless otherwise such changes and modifications depart from the scope of the present invention, they should be construed as being included therein.

What is claimed is:

1. In a multi-color copying apparatus including a plurality of developing units containing developers in different colors, respectively, in which an electrostatic latent image formed on a surface of a photosensitive member is developed into a multi-color image by selectively driving said developing units during one cycle of copying operation, the improvement comprising:

said developing units each including a magnet roller having a plurality of magnetic poles, a rotatable sleeve roller surrounding said magnet roller and a changeover means for changing over each of said developing units between a developing state and a nondeveloping state;

in at least one of said developing units disposed downstream of the remaining ones of said developing units in a rotational direction of said photosensitive member, said changeover means including a first means for effecting angular displacement of said magnet roller between developing and nondeveloping positions at which one of the magnetic poles of said magnet roller confronts and does not confront said photosensitive member, respectively, a second means for turning on said sleeve roller for its rotational drive such that at the time of changeover of said one of said developing units from the nondeveloping state to the developing state, said second means is actuated upon lapse of a predetermined time period after actuation of said first means, and said changeover means further includes a voltage impressing means for impressing a variable bias voltage to said sleeve roller such that said voltage impressing means impresses, during a time interval from actuation of said first means to actuation of said second means, a first bias voltage to said sleeve roller, with the first bias voltage being higher than a second bias voltage impressed to said developing sleeve during development by said voltage impressing means.

2. A multi-color copying apparatus as claimed in claim 1, wherein said first means includes a bearing for supporting said magnet roller rotatably and an actuating member for effecting angular displacement of said magnet roller.

3. A multi-color copying apparatus as claimed in claim 1, wherein said second means includes a motor to be turned on and off.

* * * * *